United States Patent [19]

Young

[11] 4,075,085

[45] Feb. 21, 1978

[54] PROCESS FOR TREATING ARSENIC-CONTAINING HYDROCARBON FEEDSTOCKS

[75] Inventor: Dean Arthur Young, Yorba Linda, Calif.

[73] Assignee: Union Oil Company of California, Los Angeles, Calif.

[21] Appl. No.: 724,560

[22] Filed: Sept. 20, 1976

[51] Int. Cl.[2] ..... C10G 29/04

[52] U.S. Cl. ..... 208/253

[58] Field of Search ..... 208/253, 295, 251 H

[56] References Cited

U.S. PATENT DOCUMENTS

| | | | |
|---|---|---|---|
| 1,826,146 | 10/1931 | Lachman | 208/295 |
| 1,826,147 | 10/1931 | Lachman | 208/295 |
| 3,161,584 | 12/1964 | Gleim | 208/251 H |
| 3,165,463 | 1/1965 | Gleim et al. | 208/251 H |
| 3,933,624 | 1/1976 | Myers | 208/253 |

FOREIGN PATENT DOCUMENTS

| | | | |
|---|---|---|---|
| 346,153 | 4/1931 | United Kingdom | 208/295 |

*Primary Examiner*—Delbert E. Gantz
*Assistant Examiner*—James W. Hellwege
*Attorney, Agent, or Firm*—Gregory F. Wirzbicki; Lannas S. Henderson; Richard C. Hartman

[57] ABSTRACT

Oil-soluble nickel, cobalt, or copper-containing additives are blended with a hydrocarbon feedstock containing arsenic, and the resulting solution is heated to at least 300° F to convert a large proportion of the arsenic to forms removable by conventional filtration or desalting techniques. Preferably, the feedstock-additive solution is heated to at least 500° F and is then distilled so as to produce one or more distillate fractions consisting of components that boil at atmospheric pressure at temperatures in the range 400°-900° F; such distillate fractions will contain arsenic in a concentration less that 20% of that of the feedstock.

18 Claims, 1 Drawing Figure

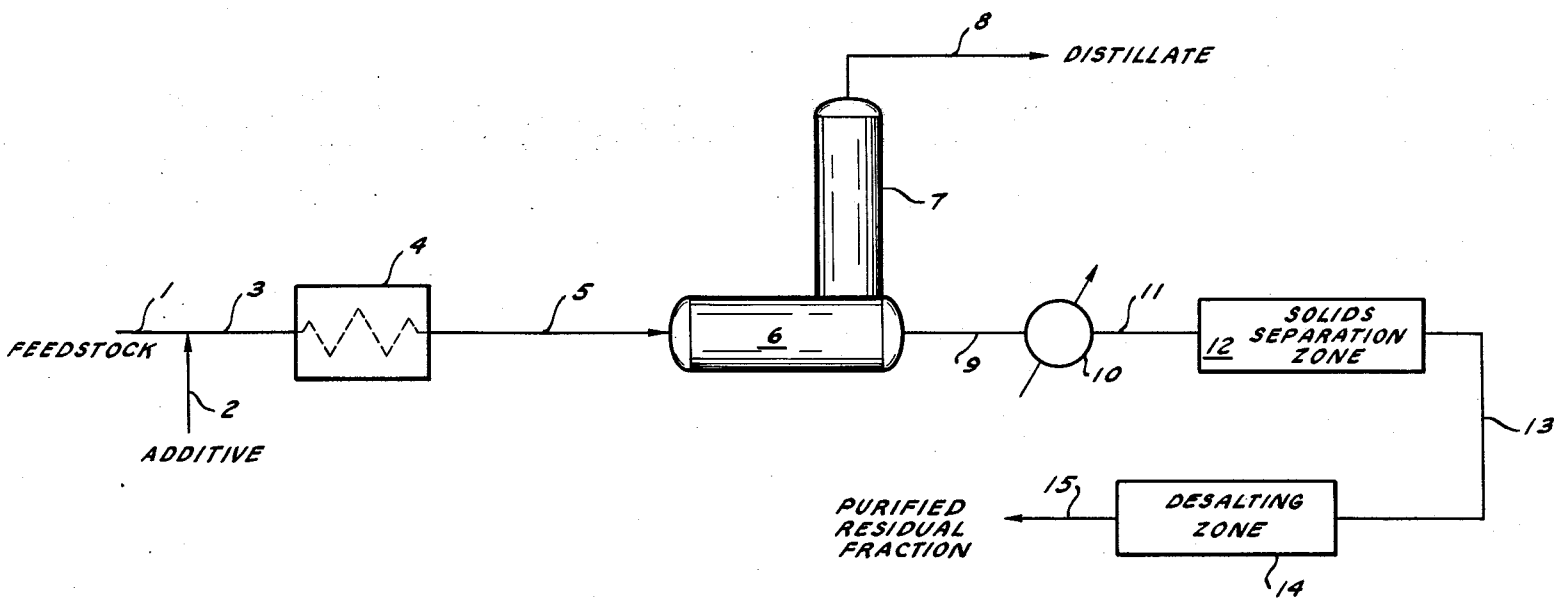
FEEDSTOCK
1
ADDITIVE
2
3
4
5
6
7
DISTILLATE
8
9
10
11
SOLIDS SEPARATION ZONE
12
13
DESALTING ZONE
14
15
PURIFIED RESIDUAL FRACTION

PROCESS FOR TREATING ARSENIC-CONTAINING HYDROCARBON FEEDSTOCKS

BACKGROUND OF THE INVENTION

1. Field of the Invention

This invention is concerned with the refining of hydrocarbon feedstocks containing arsenic. It is also concerned with removing arsenic from hydrocarbon feedstocks and producing distillate and residual fractions containing low concentrations of arsenic from a feedstock containing high concentrations of arsenic.

2. Prior Related Art

It is known that crude shale oils, especially those obtained from the Green River area of Colorado, Wyoming, and Utah, which are herein termed Colorado shale oils, contain arsenic components in concentrations ranging between about 20 and 80 ppmw (as arsenic). Since arsenic deactivates many of the catalysts used in the refining of shale oil, it is necessary to remove these arsenic components from the crude shale oil. However, the only processes presently available, such as those shown in U.S. Pat. No. 3,804,750 and 3,933,624, require high pressure and the presence of hydrogen for the removal of the arsenic components. Such operating requirements may prove uneconimical in many applications.

Moreover, even methods designed to fractionate the shale oil so as to concentrate the arsenic components in a distillate or residual fraction, thereby making it possible to remove arsenic from only a small portion of the original feedstock, have proved uneconomical. It has been shown, for example, that the arsenic components in a typical 40 ppmw arsenic-containing Colorado crude shale oil are distributed such that, upon distillation, about 5 wt. % of the arsenic components (as arsenic) will remain with the IBP-400° F distillate fraction, about 75 wt. % with the 400°-900° F distillate fraction, and about 20 wt. % with the 900° F+ residual fraction. (See Prerefining of Shale Oil, Preprints, Division of Petroleum Chemistry, Inc., ACS, 1975, Vol. 20, No. 4, pp. 765-775 at 772.) Thus, unless it is specifically desired to obtain a distillate fraction consisting of components boiling at temperatures less than 400° F, which is no more than a 10-20 wt. % fraction for a Colorado shale oil crude, distilling an arsenic-containing feedstock to obtain a distillate fraction containing arsenic in low concentrations would normally be considered uneconomical. Moreover, distilling to obtain a IBP-400° F distillate fraction would simply concentrate the arsenic in the 400° F+ fraction, thereby necessitating further post-treatment for about 80-90% of the feedstock. Hence, little benefit is presently realized by simply distilling an arsenic-containing hydrocarbon feedstock.

SUMMARY OF THE INVENTION

Briefly, in accordance with this invention, an oil-soluble nickel-containing additive is blended with an arsenic-containing hydrocarbon feedstock, preferably so that the atomic ratio of nickel to arsenic in the resulting solution is at least 1:1. When heated to at least 300° F, preferably to at least 500° F, a large proportion of the arsenic components, usually at least about 70% by weight of arsenic, is converted to solid and/or water-extractable forms removable by coventional liquid-solids separation and/or desalting techniques.

Alternatively and preferably, the feedstock-additive solution is heated to a temperature of at least 500° F and then distilled under conditions such that at least one distillate fraction is obtained that consists of components that boil in the range 400°-900° F; the concentrations of arsenic in such distillate fractions will be less than 50%, usually less than 20%, of that of the feedstock from which it came. Arsenic concentrated in the residual fraction is in solid and/or water-extractable forms removable by conventional liquid-solids separation and/or desalting techniques. After being filtered and/or desalted, the residual fraction will contain arsenic in a concentration less than that of the feedstock, usually less than about 40% of that of the feedstock. Hence, in the preferred embodiment of the invention, all distillate and residual fractions yielded from an arsenic-containing feedstock contain arsenic in concentrations less than that of the feedstock.

Oil-soluble cobalt-containing additives, although more expensive than those containing nickel, may be substituted for nickel additives, but with variable results. Oil-soluble copper-containing additives are also useful for converting a substantial proportion of arsenic to solid and/or water-extractable forms. When a copper-containing additive is blended with a feedstock, distillation of the resulting solution yields a residual fraction which, when filtered and/or desalted, contains arsenic in a concentration less than that of the feedstock, usually less than 40% of that of the feedstock.

It will be understood that the terms "arsenic" and "arsenic components" as used herein include arsenic in whatever forms, elemental or combined, it may be present. Also, all feedstock and product oil arsenic concentrations are herein calculated by weight as elemental arsenic.

BRIEF DESCRIPTION OF THE DRAWINGS

The drawing shows a flow diagram of the preferred embodiment of this invention.

DETAILED DESCRIPTION OF THE INVENTION

The hydrocarbon feedstocks contemplated to be treated by the process of this invention broadly include all hydrocarbonaceous liquids containing at least 2 ppmw arsenic, preferably at least 20 ppmw arsenic. Especially contemplated herein are synthetic hydrocarbon crudes, or fractions thereof, obtained from oil shale, solid coal, and tar sand. Arsenic concentrations in these materials normally exceed about 20 ppmw and will vary, for example, from about 20 to about 80 ppmw for shale oils and about 20 to about 1200 ppmw for coal tar distillates.

Referring now to the drawing, a solution comprising an arsenic-containing hydrocarbon feedstock fed via line 1 and an oil-soluble nickel-containing additive fed via line 2 is first introduced through line 3 into heating reactor 4, wherein it is heated to at least 300° F, preferably at least 500° F, for a residence time period of 10 minutes to 2.0 hours, with longer residence times being generally required at lower temperatures. The nickel-containing additives suitable for use in the invention comprise one or more nickel components soluble in the particular feedstock to be treated. In general, nickel components such as nickel naphthenate, nickel stearate, nickel acetate, and nickel acetylacetonate will be found useful for a wide range of hydrocarbon feedstocks, and hence are preferred. However, nickel additives vary in degree of oil solubility, and some may be more soluble in one hydrocarbon feedstock than in another. Hence, the choice of which nickel-containing additive to use in a particular situation will depend upon the nature of the feedstock, the nature of the nickel-containing additive under consideration, and the amount of nickel desired to be dissolved in the feedstock.

The additive may be introduced into the feedstock in solid or liquid forms. For ease in handling, it is preferred that the additive be in liquid form and comprise one or more nickel components dissolved or slurried in a liquid carrier. A preferred additive comprises a nickel component dissolved in an organic liquid. A specifically contemplated additive, especially for treating shale oils, comprises 0.5 vol. % nickel naphthenate and 30 vol. % toluene, with the balance being a Colorado shale oil crude or fraction thereof.

Regardless of the additive chosen and the manner of its introduction into the feedstock, at least a sufficient amount thereof is preferably added such that the charge in heating reactor 4 comprises a feedstock-additive solution containing enough dissolved nickel to convert a substantial proportion of arsenic components therein to high-boiling point constituents that remain with the distilland during the subsequent distillation to be described. It has been found that a sufficient amount of additive for a Colorado shale oil crude is that necessary to provide in said charge an atomic ratio of nickel (in dissolved nickel constituents, including those naturally present in the feedstock) to arsenic of at least 1:1. Since arsenic components in other shale oils, coal tar distillates, etc., are similar to those in Colorado shale oils, an atomic ratio of at least 1:1, dissolved nickel to arsenic, will be adequate for treating such feedstocks. Preferably, the atomic ratio of dissolved nickel to arsenic in the charge should be maintained between about 2:1 and 4:1.

After being heated in reactor 4, the feedstock-additive solution is passed via line 5 to a conventional distilling apparatus comprising a still 6 and a distillation column 7. Operating conditions within still 6 and distillation column 7 are such that at least one distillate fraction, shown being removed via line 8, comprises components that boil under atmospheric pressure at temperatures in the range of 400°–900° F. The temperature of the distilland heated in still 6 is maintained in excess of 300° F, preferably in excess of 500° F. Operating pressures are not critical, with subatmospheric pressures being preferred.

The one or more distillate fractions removed from distillation column 7 contain arsenic in concentrations less than 50%, usually less than 20%, of that of the feedstock. Usually these one or more distillate fractions comprise at least 10 wt. %, preferably 20–70 wt. %, of the feedstock-additive solution. Also preferably, at least one distillate fraction is obtained that consists of components that boil at atmospheric pressure at temperatures in the range 400°–900° F, and, if more than one such distillate fraction is obtained, they all should contain arsenic in concentrations less than 50%, preferably less than 20%, of that of the feedstock.

The residual fraction obtained in line 9 contains high-boiling point arsenic components that are also in forms extractable in water and/or solidifiable at temperatures between about 100° and 250° F (at which temperatures the bulk of the residual fraction itself usually remains liquefied). The residual fraction also contains finely divided, oil-insoluble, but water extractable, nickel arsenide compounds. Hence, a large proportion of the arsenic in the residual fraction may be removed therefrom by conventional liquid-solids separation (i.e., filtering, centrifuging, etc.) and/or desalting techniques. Thus, in the preferred embodiment of the invention the residual fraction is first cooled in heat exchanger 10 to a temperature in the range 100°–250° F, is then passed via line 11 into a solids separation zone 12 wherein all solids larger than at least 10 microns are preferably removed, and finally is passed via line 13 into a desalting zone 14. The purified residual fraction obtained in line 15 contains arsenic in a lower concentration than it is present in the feedstock. Usually, the concentration of arsenic in the purified residual fraction is less than 40% of that of the feedstock itself.

In a specific embodiment of the invention a bed of packing material, such as alundum balls, quartz chips, siliceous gravels, alumina pellets, Raschig rings, etc., is used to effect the liquid-solids separation. In this embodiment, some nickel-containing particles will deposit on the packing material and act catalytically in separation zone 12, especially if temperatures in excess of 500° F are maintained therein, to produce still more solid arsenic components that will deposit on the packing material. Preferably, temperatures in the bed of packing material will vary between 100° and 800° F, with the higher temperatures being preferred when a substantial amount of said nickel-containing particles has deposited thereon. In such an event, the need for heat exchanger 10 is obviated.

The following Examples are illustrative of the invention.

EXAMPLE I

Several samples of a crude Colorado shale oil of the following composition and properties:

Table I

| | | | |
|---|---|---|---|
| Gravity, °API | 22.5 | ASTM Distillation, | D1160, ° F |
| Sulfur, Wt. % | 0.884 | IBP/5 | 195/335 |
| Conradson Carbon, Wt. % | 2.4 | 10/20 | 392/525 |
| Hydrogen, Wt. % | 11.37 | 30/40 | 602/684 |
| Total Nitrogen, Wt. % | 1.96 | 50/60 | 748/808 |
| Basic Nitrogen, Wt. % | 1.15 | 70/80 | 868/920 |
| Arsenic, ppmw | 50 | 90/95 | 984/1033 |
| Nickel, ppmw | 3.0 max | Max | 1062 |
| Vanadium, ppmw | 2.0 max | Rec, vol. % | 97.4 |

were blended with different oil-soluble metal-containing additives, and each of the resulting solutions was distilled without being preheated at 10 mm pressure and 542° F "pot" temperature. Distillate fractions, all of whose components boiled at atmospheric pressure at temperatures ranging up to 650° F, were produced. The distillate fractions were then analyzed to determine the concentration of arsenic in each. The 650° F+ residual fractions were also analyzed for arsenic content, but only after they had been filtered at about 120° F to remove solid components nominally larger than 2 microns therefrom. The data obtained from these analyses are shown in the following Table:

Table II

| Additive[1] | Atomic Ratio Metal/Arsenic | Distillate wt. % | Distillate ppmw As | 650 + ° F Residual wt. % | 650 + ° F Residual ppmw As | % As Removed[2] |
|---|---|---|---|---|---|---|
| None | 0 | 39.2 | 29 | 60.3 | 64 | 0 |
| Zn Naphthenate | 3 | 32.0 | 35 | 67.1 | 45 | 17 |
| Fe Naphthenate | 3 | 32.8 | 65 | 66.2 | 42 | 2 |
| Cu Naphthenate | 3 | 33.3 | 60 | 66.1 | 23 | 30 |
| Ca Naphthenate | 3 | 33.3 | 38 | 66.0 | 55 | 2 |
| Mg Naphthenate | 3 | 32.6 | 45 | 66.9 | 31 | 29 |
| Ni Naphthenate | 3 | 33.7 | 5.4 | 65.7 | 45 | 37 |
| Ba Naphthenate | 3 | 33.1 | 34 | 66.3 | 62 | 0 |
| Li Acetate | 3 | 34.8 | 29 | 64.4 | 62 | 0 |
| K Acetate | 3 | 36.3 | 33 | 63.2 | 62 | 0 |
| Zn Stearate | 6 | 35.0 | 38 | 64.2 | 62 | 0 |
| Zn Stearate | 3 | 35.7 | 29 | 63.5 | 60 | 3 |
| Al Stearate | 6 | 34.3 | 31 | 64.9 | 64 | 0 |
| Al Stearate | 3 | 34.7 | 26 | 64.6 | 67 | 0 |

[1]All stearate salts were added as a solid. Naphthenates and acetate salts were dissolved in xylene and glacial acetic acid, respectively; liquid additives comprised 0.5 vol. % of feedstock-additive solutions.
[2]The % arsenic removed by filtration is equal to total arsenic in the feestock less that in the distillate and residual fractions divided by the arsenic in the feedstock.

The data in Table II show the superiority of a nickel-containing additive, in comparison to any other metal-containing additive, for producing a distillate fraction of reduced arsenic content. As shown, the arsenic concentration of the distillate fraction produced from the feedstock-nickel additive solution was 5.4 ppmw. With no other feedstock-metal additive solution could a distillate fraction containing less than 10 ppmw arsenic be obtained. Moreover, the data also indicate that sufficient arsenic was converted to solid forms in the liquid residual fraction such that, after filtration at a temperature in the range 100°–250° F, said residual fraction contained arsenic in a concentration less than that of the feedstock. Hence, the process of the invention may be used to simultaneously produce one or more distillate fractions and a filtered residual fraction, all of which fractions contain arsenic in concentrations less than the arsenic concentration of the feedstock.

EXAMPLE II

Various oil-soluble metal components were added to a crude Colorado shale oil of composition and properties shown in Table I to produce solutions containing metal and arsenic in an atomic ratio of 3:1, total metal:arsenic. The solutions were refluxed at 540° F for the indicated time shown in Table III and then fractionated at 10 mm Hg pressure. The distillate and residual fractions so obtained were filtered at 120° F to remove solid components nominally larger than 2 microns. The residual fractions were then washed with 0.5 N $NH_4OH$. The arsenic concentrations in the filtered fractions and the washed residual fraction are shown in Table III.

Table III

| Additive[1] | Hours at 540° F | Arsenic Concentration in Distillate and Residual Fractions, ppmw: IBP - 400° F, 12 wt. % | 400° -700° F 31 wt. % | 700° -900° F 27 wt. % | Filtered 900° F+, 30 wt. % | Washed 900° F+, 30 wt. % |
|---|---|---|---|---|---|---|
| None | 4 | 3.0 | 80 | 28 | 62 | 56 |
| Ni | 4 | 1.8 | 4.8 | 5.4 | 17 | 18 |
| Ni | 2 | 3.6 | 5.6 | 5.0 | 116 | 16 |
| Cu | 4 | 0.8 | 80 | 22 | 24 | 12 |
| Fe | 4 | 2.2 | 94 | 19 | 56 | 42 |
| Zn | 4 | 4.4 | 68 | 20 | 76 | 64 |
| Ni+Cu | 4 | 2.4 | 4.6 | 4.0 | 106 | 15 |
| Ni+Fe | 4 | 2.6 | 7.2 | 6.4 | 74 | 22 |
| Mo | 4 | 2.8 | 80 | 16 | 58 | 38 |
| Ni+Mo | 4 | 2.8 | 4.4 | 4.4 | 60 | 30 |
| Ni+Mo | 2 | 1.6 | 5.2 | 4.0 | 84 | 24 |

[1]All metals were added in the form of naphthenates dissolved in xylene except molybdenum, which was added as a solid acetylacetonate. When two or more metals were added, the solution contained said metals in a 1:1 atomic ratio. All feedstock-naphthenate additive solutions contained 0.5 vol.% of additive.

The data in Table III again show the superiority of a nickel-containing additive, in comparison to any other metal-containing additive, for producing distillate fractions of reduced arsenic content. Most particularly, distilling a feedstock-nickel additive solution reduces the concentration of arsenic in fractions consisting of components that boil at temperatures between 400° and 900° F from about 25–80 ppmw (obtainable with other additives) to less than about 5 ppmw. Hence, the use of an oil-soluble nickel-containing additive markedly alters the arsenic distribution in the distilled fractions; instead of about 75% of the arsenic components (by weight of arsenic) being concentrated in the 400°–900° F boiling range, as is known to be typical when no additive is used, less than about 7% are so concentrated when a nickel-containing additive is used. Moreover, the arsenic components concentrate in the 900° F+ residual fraction in forms largely removable therefrom by filtration and desalting techniques.

As shown in Tables II and III, the distillation of a feedstock, to which an oil-soluble copper-containing additive has been introduced, produces a residual fraction containing arsenic in forms removable by filtration and/or desalting techniques. Hence, distilling a feedstock-copper additive solution containing dissolved copper to arsenic in at least a 1:1 atomic ratio, but preferably in a ratio between 2:1 and 4:1, under conditions hereinbefore recited for feedstocks blended with nickel-containing additives, produces a residual fraction which, when filtered and/or desalted, contains arsenic in a concentration less than that of the feedstock itself. As with feedstocks to which a nickel additive has been introduced, residual fractions contaning arsenic in concentrations less than 40% of those of the respective feedstocks from which they came are obtainable.

Cobalt-containing additives, while contemplated for use in the invention, are not preferred. The cost of such additives is usually prohibitive, and the results obtained are variable. However, when such additives are used, they should be added in the atomic ratios hereinbefore specified for nickel and copper, and the resulting solutions distilled under the preferred conditions hereinbefore specified.

Additives comprising combinations of nickel, copper, and cobalt components should be blended with the feedstock to provide a dissolved metal to arsenic ratio of at least 1:1, preferably between 2:1 and 4:1, in the distilland. The feedstock-additive solution should be distilled under the preferred conditions hereinbefore specified.

In an alternative embodiment of the invention involving no distillation, an oil-soluble nickel additive is dissolved in the feedstock, and the resulting solution is passed to reactor 4 maintained at a temperature of at least 300° F, preferably at least 500° F. As before, the nickel additive is preferably introduced so that the dissolved nickel to arsenic ratio in the reactor is at least 1:1. Residence times in the reactor must be such that a substantial proportion of the arsenic components will be converted, as herinbefore described, to forms removable subsequently by filtration and/or desalting techniques; residence times of 10 minutes to 2 hours usually prove sufficient. Once the solidified and/or water-estractable arsenic components have been removed, a purified product oil containing arsenic in a concentration less than 40%, usually less than 20%, of that of the feedstock is produced. For a typical Colorado shale oil containing 20–80 ppmw arsenic, the arsenic concentration therein is usually reduced to less than about 8 ppmw by this method.

When oil-soluble copper and/or cobalt-containing additives are added to an arsenic-containing hydrocarbon feedstock, the resulting solution may also be treated in a manner as just described; however, while a product oil of reduced arsenic content will be produced, such additives will not usually prove as effective under comparable conditions as a nickel-containing additive added to the same feedstock. Additives containing copper, nickel, and cobalt in various combinations will prove more effective as the concentration of nickel is increased therein.

In a specific embodiment of the invention, oil-soluble additives comprising one or more nickel, copper, and cobalt components (but preferably those comprising nickel) are blended with an arsenic-containing feedstock entering a hydrotreater, hydrocracker, or other unit containing a catalyst that deactivates in the presence of solubilized arsenic. Under the conditions maintained in such units, the arsenic will be converted to solid forms which will deposit innocuously on the catalyst, thereby largely protecting the catalyst from being deactivated. When the deposition becomes excessive, the deposited material can be removed from the catalyst by conventional cleaning methods, such as by backflushing with a light oil.

The following Examples demonstrate the use of an oil-soluble nickel component for removing arsenic from a shale oil.

EXAMPLE III

Each of two 920 gm samples of a Colorado shale oil crude containing 50 ppmw arsenic was placed in an autoclave that was subsequently pressurized with hydrogen. To one of the samples had been added sufficient nickel naphthenate so that a shale oil-additive solution containing 77 ppmw of nickel was produced. Within the autoclave, pressures and temperatures were changed hourly, as shown in Table IV. Samples were removed hourly, then filtered and analyzed for arsenic. The filtered samples were then shaken with equal volumes of 2 wt. % $(NH_4)_2S$ in 0.5 N $NH_4OH$ for 1 hour at ambient conditions; the oil phase was then analyzed for arsenic. Data obtained from the analyses for arsenic in the filtered and desalted samples are reported in Table IV.

Table IV

| Additive | Ni:As | Time Duration, hrs. | Temp., ° F | Pressure psig | Arsenic Concentration Filtered, ppmw | Arsenic Concentration Washed, ppmw |
|---|---|---|---|---|---|---|
| None | 0 | 0 – 1 | 355 | 80 | 41 | 24 |
| | | 1 – 2 | 605 | 100 | 30 | 12 |
| Nickel[1] | 1.96 | 0 – 1 | 375 | 85 | 23 | 5.3 |
| | | 1 – 2 | 660 | 110 | 18 | 2.3 |
| | | 2 – 3 | 650 | 110 | 15 | 1.7 |

[1]Nickel additive comprised 0.5 vol. % of feedstock-additive solution and was composed of nickel naphthenate dissolved in xylene.

EXAMPLE IV

Five 370 gm samples of a 650° F+ Colorado shale oil residual fraction containing 39 ppmw arsenic were blended with the additives shown in Table V in the amounts shown therein. The solutions so formed and the one sample containing no additive were each heated to 650° F for 2 hours. They were then filtered and analyzed for arsenic. The filtered liquids were then blended with equal volumes of 0.5 N $NH_4OH$ and allowed to stand at 180° F to facilitate phase separation. The oil phases were then analyzed for arsenic. The data obtained from the arsenic analyses are shown in Table V. As shown, the results obtained with the nickel additives were clearly superior to those obtained from the magnesium or zinc additives.

Table V

| Additive | Volume Ratio[1] | Added Metal Conc., ppmw | Metal:As Atomic Ratio | Product As Conc. Filtered Product, ppmw | Product As Conc. Washed Product, ppmw |
|---|---|---|---|---|---|
| 0.5M Nickel Naphthenate in glycol ether | 2:1000 | 64 Ni | 2.09 | 11 | 4.0 |
| " | 4:1000 | 128 Ni | 4.18 | 11 | 3.4 |
| 0.5M Nickel Acetate in glacial acetic acid | 4:1000 | 128 Ni | 4.18 | 8.7 | 3.2 |

Table V-continued

| Additive | Volume Ratio[1] | Added Metal Conc., ppmw | Metal:As Atomic Ratio | Product As Conc. Filtered Product,ppmw | Product As Conc. Washed Product,ppmw |
|---|---|---|---|---|---|
| 0.4M Magnesium Naphthenate in xylene | 5:1000 | 53 Mg | 4.18 | 36 | 24 |
| 0.5M Zinc Naphthenate in xylene | 4:1000 | 142 Zn | 4.18 | 34 | 18 |
| None | 0:1000 | 0 | 0 | 35 | 23 |

[1]Ratio of additive solution to 650° F + residual.

While the invention has been described in conjunction with specific embodiments and examples thereof, it is evident that many alternatives, modifications, and variations will be apparent to those skilled in the art in light of the foregoing description. Accordingly, it is intended to embrace all such alternatives, modifications, and variations that fall within the spirit and scope of the appended claims.

I claim:

1. A process comprising (a) heating at a temperature of at least 300° F a liquid solution comprising (1) a hydrocarbon feedstock containing at least 2 ppmw arsenic, said hydrocarbon feedstock being a synthetic crude, or fraction thereof, obtained from oil shale, solid coal, or tar sands, and (2) an oil-soluble additive comprising one or more nickel, copper, or cobalt components, said heating being carried out for a time sufficient to convert at least some of the arsenic in said solution to arsenic components selected from the class consisting of those extractable in water and those that exist as an undissolved solid at 100°–250° F;

(b) separating at least some of said arsenic components from said solution; and (c) withdrawing from step (b) a purified oil containing arsenic in a concentration less than that of the feedstock.

2. A process as defined in claim 1 wherein said additive comprises one or more nickel components and said heating is at a temperature of at least 500° F.

3. A process as defined in claim 2 wherein said purified oil contains arsenic in a concentration less than 40% of that of the feedstock.

4. A process as defined in claim 2 wherein said feedstock contains at least 20 ppmw arsenic.

5. A process comprising:

(a) heating at a temperature of at least 300° F a liquid solution comprising (1) a hydrocarbon feedstock containing at least 2 ppmw arsenic, said hydrocarbon feedstock being a synthetic crude, or fraction thereof, obtained from oil shale, solid coal, or tar sands, and (2) an oil-soluble additive comprising one or more nickel components;

(b) distilling the heated solution into a residual fraction and at least one distillate fraction comprising components that boil at atmospheric pressure at temperatures in the range 400°–900° F; and (c) withdrawing from said distilling step a distillate fraction containing arsenic in a concentration less than 50% of that of the feedstock.

6. A process as defined in claim 5 wherein said heating is at a temperature of at least 500° F.

7. A process as defined in claim 6 wherein said feedstock is a shale oil and said distillate fraction contains arsenic in a concentration less than 20% of that of the feedstock.

8. A process as defined in claim 6 wherein said feedstock contains at least 20 ppmw arsenic.

9. A process as defined in claim 8 wherein said distillate fraction consists of components that boil at atmospheric pressure at temperatures in the range of 400°–900° F.

10. A process as defined in claim 8 wherein said distillate fraction consists of components that boil at atmospheric pressure at temperatures in the range of 400°–700° F.

11. A process as defined in claim 6 comprising the further steps of:

(d) separating from said residual fraction at least some arsenic components selected from the class consisting of those extractable in water and those that exist as an undissolved solid at 100°–250° F; and (e) withdrawing from step (d) a purified residual fraction containing arsenic in a concentration less than that of the feedstock.

12. A process as defined in claim 11 wherein said feedstock contains at least 20 ppmw arsenic and said distillate fraction contains arsenic in a concentration less than 20% of that of the feedstock.

13. A process as defined in claim 12 wherein said residual fraction contains arsenic in a concentration less than 40% of that of the feedstock.

14. A process comprising:

(a) heating at a temperature of at least 300° F a liquid solution comprising (1) a hydrocarbon feedstock containing at least 2 ppmw arsenic, said hydrocarbon feedstock being a synthetic crude, or fraction thereof, obtained from oil shale, solid coal, or tar sands, and (2) an oil-soluble additive comprising one or more nickel, copper, or cobalt components;

(b) distilling the heated solution into a residual fraction and at least one distillate fraction;

(c) separating from said residual fraction at least some arsenic components selected from the class consisting of those extractable in water and those that exist as an undissolved solid at 100°–250° F in said residual fraction; and (d) withdrawing from step (c) a purified residual fraction containing arsenic in a concentration less than that of the feedstock.

15. A process as defined in claim 14 wherein said additive comprises one or more nickel components and said heating is at a temperature of at least 500° F.

16. A process as defined in claim 15 wherein said feedstock contains at least 20 ppmw arsenic.

17. A process as defined in claim 16 wherein said feedstock is a shale oil and said residual fraction contains arsenic in a concentration less than 40% of that of the feedstock.

18. A process as defined in claim 17 wherein said solution contains dissolved nickel in an atomic ratio to arsenic of at least 1:1.

* * * * *